US007341324B2

(12) United States Patent
Juve et al.

(10) Patent No.: US 7,341,324 B2
(45) Date of Patent: Mar. 11, 2008

(54) PRE-WARMING PORTIONS OF AN INKJET PRINTHEAD

(75) Inventors: Ronald A. Juve, Brush Prairie, WA (US); James M. Brenner, Vancouver, WA (US); Jason Quintana, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 474 days.

(21) Appl. No.: 10/691,311

(22) Filed: Oct. 22, 2003

(65) Prior Publication Data

US 2005/0088474 A1 Apr. 28, 2005

(51) Int. Cl.
*B41J 29/38* (2006.01)
*B41J 2/05* (2006.01)

(52) U.S. Cl. ..... 347/17; 347/60

(58) Field of Classification Search ..... 347/14, 347/60–61, 17, 19, 57, 16
See application file for complete search history.

(56) References Cited

U.S. PATENT DOCUMENTS 5,896,146 A 4/1999 Murata et al.
5,984,455 A * 11/1999 Anderson ..... 347/47
6,224,195 B1 5/2001 Maru et al.
6,296,350 B1 * 10/2001 Cornell et al. ..... 347/60
6,359,701 B1 * 3/2002 Yamada et al. ..... 358/1.2
6,398,333 B1 * 6/2002 Mulay et al. ..... 347/14
6,540,316 B1 * 4/2003 Imanaka et al. ..... 347/14
6,612,673 B1 * 9/2003 Giere et al. ..... 347/14
6,634,735 B1 * 10/2003 Silverbrook ..... 347/54
6,808,243 B1 * 10/2004 Markham et al. ..... 347/14
2002/0018086 A1 * 2/2002 Kao et al. ..... 347/12
2002/0047873 A1 4/2002 Imanaka et al.
2002/0057305 A1 5/2002 Kao et al.
2002/0145645 A1 * 10/2002 Aono et al. ..... 347/48
2003/0137575 A1 * 7/2003 Peterson et al. ..... 347/121

FOREIGN PATENT DOCUMENTS

EP 0867286 A3 3/2000

OTHER PUBLICATIONS

Search Report for U.K. Patent Application No. GB0422722.9 (filed Oct. 13, 2004), Jan, 2005.

* cited by examiner

*Primary Examiner*—Matthew Luu
*Assistant Examiner*—Lisa M Solomon

(57) ABSTRACT

An embodiment of a printing system is provided with an inkjet printhead having plural portions each having an ink-ejecting nozzle. The printing system includes plural heater elements each associated with one of the plural portions to pre-warm ink dispensed by the nozzle of the associated portion in response to a pre-warming signal. The printing system also includes a controller configured to generate the pre-warming signal for one or more heater elements based on a selection criteria for generating the pre-warming signal only when the nozzle of said associated portion is required to eject ink during an upcoming print swath.

12 Claims, 4 Drawing Sheets

PRE-WARMING PORTIONS OF AN INKJET PRINTHEAD

BACKGROUND

Inkjet printheads typically move across print media, such as paper, one swath at a time while selectively ejecting ink droplets from nozzles to form a desired image. For thermal inkjet printheads prior to beginning each swath, ink in ejection chambers associated with each nozzle is pre-warmed to a uniform temperature in earlier designs for both monochrome and multi-color ejecting printheads. When printing only one or a few colors from a multi-color printhead, excess energy is used to pre-warm the ink of colors which are not used during the swath. Unnecessary heat applied to the printhead may cause premature aging, reducing printhead lifetime, as well as consuming additional power unnecessarily increasing operating and manufacturing costs in terms of oversized power supplies.

SUMMARY

An embodiment of a printing system is provided with an inkjet printhead having plural portions each having an ink-ejecting nozzle. The printing system includes plural heater elements each associated with one of the plural portions to pre-warm ink dispensed by the nozzle of the associated portion in response to a pre-warming signal. The printing system also includes a controller configured to generate the pre-warming signal for one or more heater elements based on a selection criteria for generating the pre-warming signal only when the nozzle of said associated portion is required to eject ink during an upcoming print swath.

BRIEF DESCRIPTION OF THE DRAWINGS

The present invention can be further understood by reference to the following description and attached drawings that illustrate the preferred embodiment(s). Other features and advantages will be apparent from the following detailed description of the preferred embodiment(s), taken in conjunction with the accompanying drawings, which illustrate, by way of example, the principles of the invention.

DETAILED DESCRIPTION OF THE PREFERRED EMBODIMENTS

In the following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview

Figure 1:
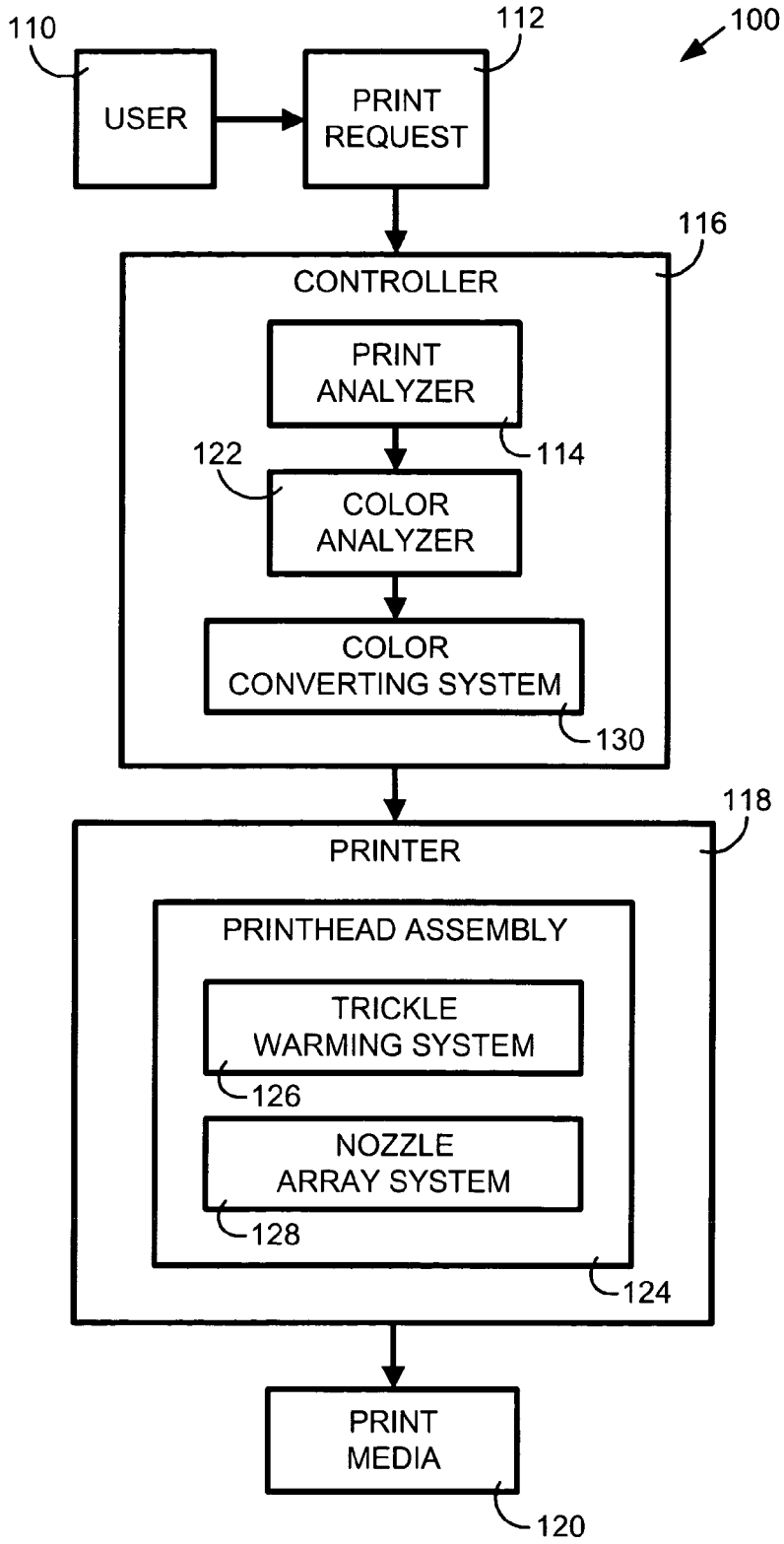
FIG. 1 is a block diagram showing one embodiment of the present invention.

FIG. 1 is an overview block diagram showing one embodiment of the printing system 100 constructed in accordance with the present invention. A user 110 initiates a print request 112 which may be received by a print analyzer 114 portion of a controller 116. The print analyzer 114 may be activated in response to request 112 for among other purposes monitoring the data sent to an inkjet printing mechanism, here referred to as printer 118, although other printing mechanisms may employ the concepts described herein, such as plotters, photographic printers, facsimile machines, etc. In one embodiment, the controller 116 is comprised of software, often referred to as a "printer driver" that resides on a computer system (not shown) that is accessible to the user 110 and in communication with printer 118. In alternative embodiments, portions of the controller 116 may be incorporated in software, firmware and/or hardware of printer 118 and/or a computer in communication with the printer.

The print request 112 may be comprised of print commands and print data associated with a print job to produce a desired image on a print media 120, such as paper, transparencies, fabric, etc. The controller 116 may include a color analyzer system 122 which receives data from the print analyzer 114 and separates it into discrete color modules for each page and/or swath of a print job. The analyzed print data may include command object code that represents color as well as color intensity, which are then assigned electronic codes by a color converting system 130 of controller 116.

The color coded information from converting system 130 may then be sent as input data to a printhead assembly 124 of printer 118. A pre-warming or trickle warming system 126 operates to pre-warm ink prior to the beginning of each print swath, such as by sending low power current pulses to firing resistors associated with ink-ejecting nozzles of a nozzle array system 128, although a separate series of separate pre-warming resistors may be used in some implementations. These pre-warming current pulses are at a lower level of power than firing pulses used to eject ink from the printhead nozzles. The printhead may also include one or more temperature sensing resistors (TSR's) used to provide feedback to controller 116 as to the current temperature of the printhead.

The trickle warming system 126 may include power field effect transistors (FET's) and provide the capability to warm the printhead 124 to any desired temperature before and during the printing operation. The pre-warming process is often referred to as "trickle warming" because the printhead allows a trickle of energy to flow through the warming device. The temperature of printhead assembly 124 rises until the desired temperature is reached and the warming devices may then be shut off or held at a controlled warming level.

The warming devices may be activated by the color analyzer system 122 according to the need to print a particular color or colors. In one embodiment, the warming devices may be divided into color coded sections that lie as close as possible to the associated resistors of the nozzle array system 128, and may be back-to-back MOSFET transistors. The firing resistors associated with the warming devices may be switched on by the combination of the firing of the address decode, address and data decodes, and the "and" block and the level shifter. Further, the determination of whether a nozzle has been selected as a data receiver may be based on whether the address in the primitive matches the address of the nozzle transistor and trickle warmer 126. In one embodiment, the nozzles, the resistors and the warming devices associated with a particular color may be arranged in columns or substantially linear arrays on the printhead 124, so that the trickle warmer 126 when activated only warms that section of the printhead die associated with the color that is required. This reduces the amount of energy that is consumed from that required if all columns were warmed using earlier systems.

For example, for a tri-color inkjet printhead ejecting cyan, yellow and magenta colored inks, six nozzle columns may be provided, typically with two columns for each color arranged side-by-side in parallel pairs. In the past, prior to printing a swath the nozzles of all six columns were pre-heated to a pre-warming temperature, whether or not all of the colors were to be used in the upcoming swath. Instead, with the present partial printhead pre-warming system, if only cyan ink is needed during the next print swath, then the yellow and magenta inks are not preheated. Similarly, if a green color is required for the next print swath, only the cyan and yellow inks are preheated, not the magenta ink. Pre-warming nozzles which were not used was a waste of power, and required power supplies to be designed to handle full power warming for each and every swath. Use of the partial printhead pre-warming system described herein, where only the colors or nozzle columns which are to be used in an upcoming swath are pre-warmed, saves on pre-warming power expended for some swaths, reducing average power needed for the printhead and thus allowing optimization in power supply design.

II. Operation of the Printing System

Figure 2:
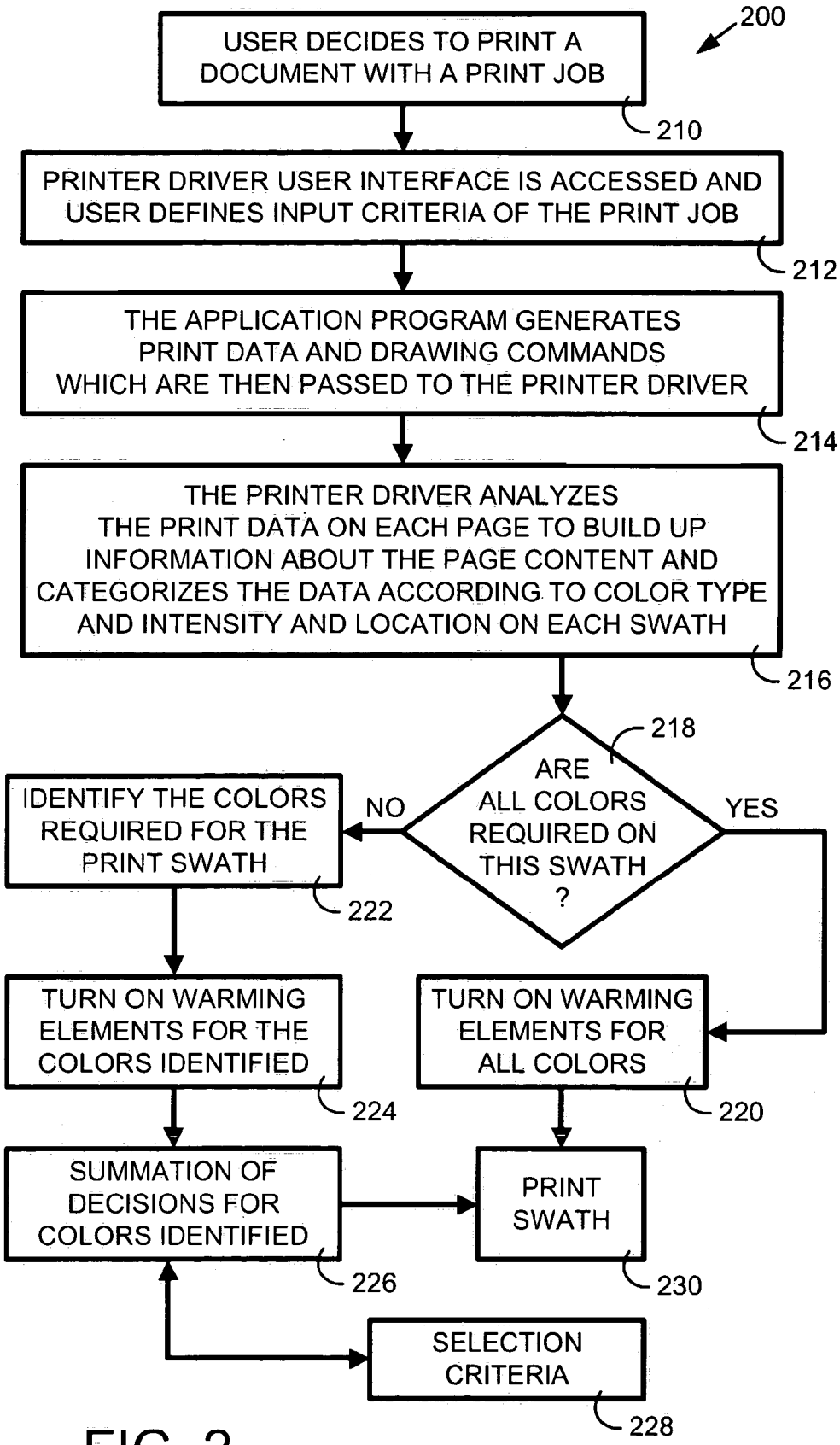
FIG. 2 is a flow chart showing one embodiment of the present invention.

FIG. 2 is a flow chart showing one embodiment of a method 200 of operating the system of FIG. 1 where in a first operation 210 a user decides to print a document or other image with a print job. In response to operation 210, in a second operation 212, the printer driver user interface may be accessed by the user to define input criteria of the print job. Operation 212 may be accomplished in any suitable manner, such as accessing a user interface of the printer driver after an application programming interface or dialog box is initiated and a printer is selected from the dialog box. The input criteria may include media size, media type, color, etc. The input criteria may include the type of print quality, often labeled as "draft," "normal," or "best," which in some implementations may be input through a keypad on printer 118. Alternatively, default print criteria may be used without the user needing to make any special choices.

In a third operation 214, the application program may generate print data and drawing commands, which may then be passed to the printer driver. In a fourth operation 216, the printer driver may analyze the print data on a specific page to develop information about the page content, such as intensity and color information. In operation 216, the printer driver may also then categorize the print data according to pre-specified categorization criteria, categorize the print data according to color type, intensity and location for each swath. Classification of the document or image may be predefined and set up by the administrator, which includes a breakdown of the print data into object types, such as image size, image color, image color depth, etc., as well as information that may be used to differentiate between clip-art images and photographic images. For example, a print job containing two images, one being black text and the other a color photographic image or business graph, may be analyzed by the print analyzer 114 and color analyzer 122 by operations 214 and 216 to generate images having, for instance, respective sizes of 10 by 50 pixels (black) and 30 by 100 pixels (color).

In a fifth operation 218, a determination may be made as to whether all colors ejected by a multi-color printhead are required to be printed on an upcoming swath. If so, a YES signal is sent to a sixth operation 220 where the trickle warming system 126 turns on the warming elements for all colors. If in the determination operation 218 it is determined that less than all of the colors are required for the upcoming swath, a NO signal is issued to a seventh operation 222, as an alternative to a sixth operation 220. In operation 222, an identification is made of which colors of the multi-colored printhead are required to print the upcoming swath.

Following the color identification operation 222, in an eighth operation 224, the trickle warming system 126 turns on the warming elements for only the colors identified in operation 222, leaving the warming elements for colors which are not used in the upcoming swath deactivated. In a ninth operation 226, a summation is made of the decisions for the colors identified (fewer than all on the multi-colored printhead), based on selection criteria 228, such as one or more of the criteria listed in Table 1, below. In a tenth operation 230, printing the upcoming swath is performed.

TABLE 1

Selection Criteria for Controlling Pre-Warming of Printhead Portions

| Selection Criteria 228 | Pre-Warming? |
|---|---|
| Color Based | Only colors used in upcoming swath |
| Media Based | Only certain dye loads of colors |
| Print Quality Based | (a) Only certain dye loads of colors, or (b) Only certain nozzle columns |
| Mid-Swath Based | Stop if nozzles not needed in swath |
| Beginning of Printing | Stop after swath starts |
| Temperature Based | Stop if printing maintains temperature |

A system for controlled pre-warming of only a portion(s) of an inkjet printhead prior to printing based upon one or more selection criteria, such as those listed by way of example in Table 1 is described in greater detail below, but first, a brief overview of the criteria examples is presented. The first embodiment uses a color based selection criteria, where only the colors of ink in the upcoming swath are pre-warmed. The second embodiment uses a media based selection criteria, with the type of media being used to determine which dye loads of colors are pre-warmed. The third embodiment uses a print quality based selection criteria, where the print quality (e.g., best, normal or draft) is used to determine which (a) dye loads of colors or (b) nozzle columns are pre-warmed. The fourth embodiment uses a mid-swath based selection criteria, were nozzles which are used initially during a print swath and later no longer needed, have pre-warming ceased at the point where they are no longer required. The term "mid-swath" may be a slight misnomer, but to clarify, this turn off point need not be at the middle of the swath, but somewhere between the beginning and end of the swath sometime after the nozzles are no longer required. The fifth embodiment uses a beginning of printing based selection criteria, where the pre-warming is stopped after printing has begun. The sixth embodiment uses a temperature based selection criteria, where pre-warming is stopped during a print swath when nozzle firing is capable of maintaining portions of the printhead at the desired pre-warming temperature. This temperature based selection criteria system facilitates independent temperature control of portions of the printhead during a print swath.

Depending upon which selection criteria 228 are used to control the pre-warming of a portion(s) of printhead 124, the decisions of the criteria used may be combined in the summation action 226 for the colors initially identified in action 222. For instance, media based and mid-swath based selection criteria may be combined to initially pre-warm only certain dye loads of colors before beginning a print swath, with pre-warming stopping during the swath for nozzles which are no longer needed to conclude the swath. Another selection criteria may also be added to the media based and mid-swath based selection criteria, such as the temperature based selection criteria which causes the pre-warming to stop if the printing process maintains the pre-warming temperature while the nozzle(s) is still in use. As another example of combining selection criteria, the color based and beginning of printing selection criteria may be combined to only pre-warm ink of colors used in the upcoming swath, then pre-warming stops after printing of the swath starts. It is apparent that other combinations of selection criteria may be made, or the criteria may be used independently.

III. Printing System

Figure 3:
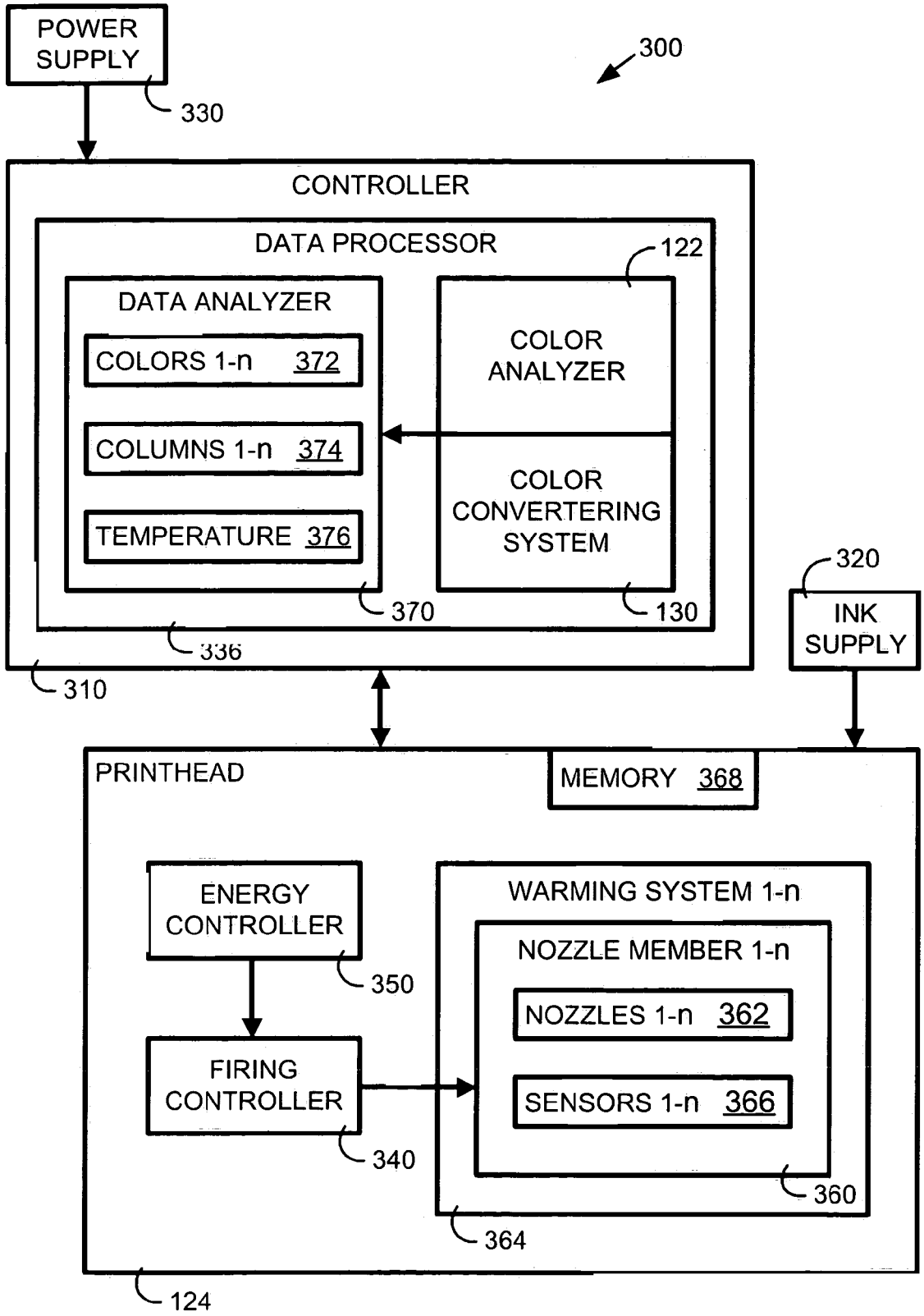
FIG. 3 is a detailed block diagram of a printing environment incorporating one embodiment of the present invention.

FIG. 3 shows a detailed block diagram of a printing system 300 incorporating one embodiment of the present invention; however the invention may be incorporated in any multi-color or multi-nozzle printhead and/or printer configuration. Referring to FIGS. 1 and 2 along with FIG. 3, the printing system 300 includes a controller 310 and printhead 124, which is in fluid communication with an inkjet ink supply 320. The controller 310 and the printer 118, as well as printhead assembly 124, may receive power from an internal and/or external power supply 330. The controller 310 may include a data processor 336 that may include several components discussed further below.

The printhead 124 may include a firing controller 340 which receives firing and pre-warming energy from an energy controller 350. The printhead 124 also includes a nozzle member 360, illustrated in block form as including the first through final nozzles 362, which forms a portion of a warming system 364. The warming system 364 may be electrically coupled to the firing controller 340, which receives activation signals from the data processor 336 to initiate trickle warming. The nozzle member 360 also includes temperature sensors 366, which may be temperature sensing resistors (TSR's). As used in the drawing figures, the designation "1-n" indicates a complete series of items, with "1" representing the first item of the series, the hyphen denoting the word "through," and the final item being represented by the variable "n." The printhead may also include a memory portion 368, although alternatively, some or all of the memory portion 368 may be provided as a portion of controller 310.

The data processor 336 forwards data for a page to be printed to the memory 368 following analysis by a data analyzer 370 portion of data processor 336. The data analyzer 370 analyzes the print data swath by swath, looking at which colors 372 are to be printed, which columns of printhead nozzles 374 are to be used, as well as the required pre-warming temperature for those colors 372 and nozzles 374 which will be used. According to operation 218 (FIG. 2), the data analyzer 370 determines whether all colors are to be printed in an upcoming swath, or whether less than the total number of colors 372 are to be printed on a swath. The determination of colors 372 may lead the data analyzer 370 to determine which of columns 374 will be activated, as specific colors are associated with specific addresses on the warming system 364 on the printhead 124. Having the addresses in close proximity on the printhead 124 means that less power may be required to warm adjacent columns on the nozzle member 360.

For example, for a tri-color inkjet printhead ejecting cyan, yellow and magenta colored inks, six nozzle columns may be provided, typically with two columns for each color arranged side-by-side in parallel pairs. By locating the two nozzle columns for a given color beside one another, a localized heating effect is achieved as residual heat is shared between the two columns. Use of the partial or localized printhead pre-warming system described herein further aids in saving energy, reducing average power needed for the printhead and thus allowing optimization in power supply design.

The data analyzer 370 may also include a temperature feedback system 376 configured to receive information from the temperature sensors 366 on the nozzle member 360 regarding the operating temperature of the printhead. If the temperature is below a threshold for those nozzles 362 to be engaged in printing the upcoming swath, the data analyzer 370 sends an activation signal through the energy controller 350 system to the firing controller 340. This pre-warming activation signal may be coupled to the color 372 addresses identified above, for the same printed page. The energy required to effect the warming of columns is efficiently maintained without compromising the flexibility of the operation to print a variety of printed pages.

In one embodiment, the data processor 336 dynamically formulates decisions to perform firing and timing operations based on the sensed print data from the color analyzer 122 and color converting system 130, and gives operating information for regulating the temperature of, and the energy delivered to, the printhead 124. These dynamically formulated decisions of data processor 336 may be based on, among other things, sensed temperatures of printhead 124, sensed amount of power supplied, real time tests, and pre-programmed known optimal operating ranges such as temperature ranges, energy ranges, scan axis directionality errors, etc. As a result, the data processor 336 enables efficient operation of the printhead 124 and produces droplets of ink in a desired pattern with a minimum energy consumption. As mentioned above with respect to controller 116, the various controller components, such as data processor 336, data analyzer 370, temperature controller 376, color analyzer 122 and color converting system 130, may be programming modules within controller 310, configured as an application specific integrated circuit (ASIC). In other embodiments, some of the components of controller 310 may be comprised of software, often referred to as a "printer driver" which resides on a computer system (not shown) in communication with printer 118. In alternative embodiments, portions of the controller 310 may be incorporated in software, firmware and/or hardware of printer 118 and/or a computer in communication with the printer.

IV. Component Details

Figure 4:
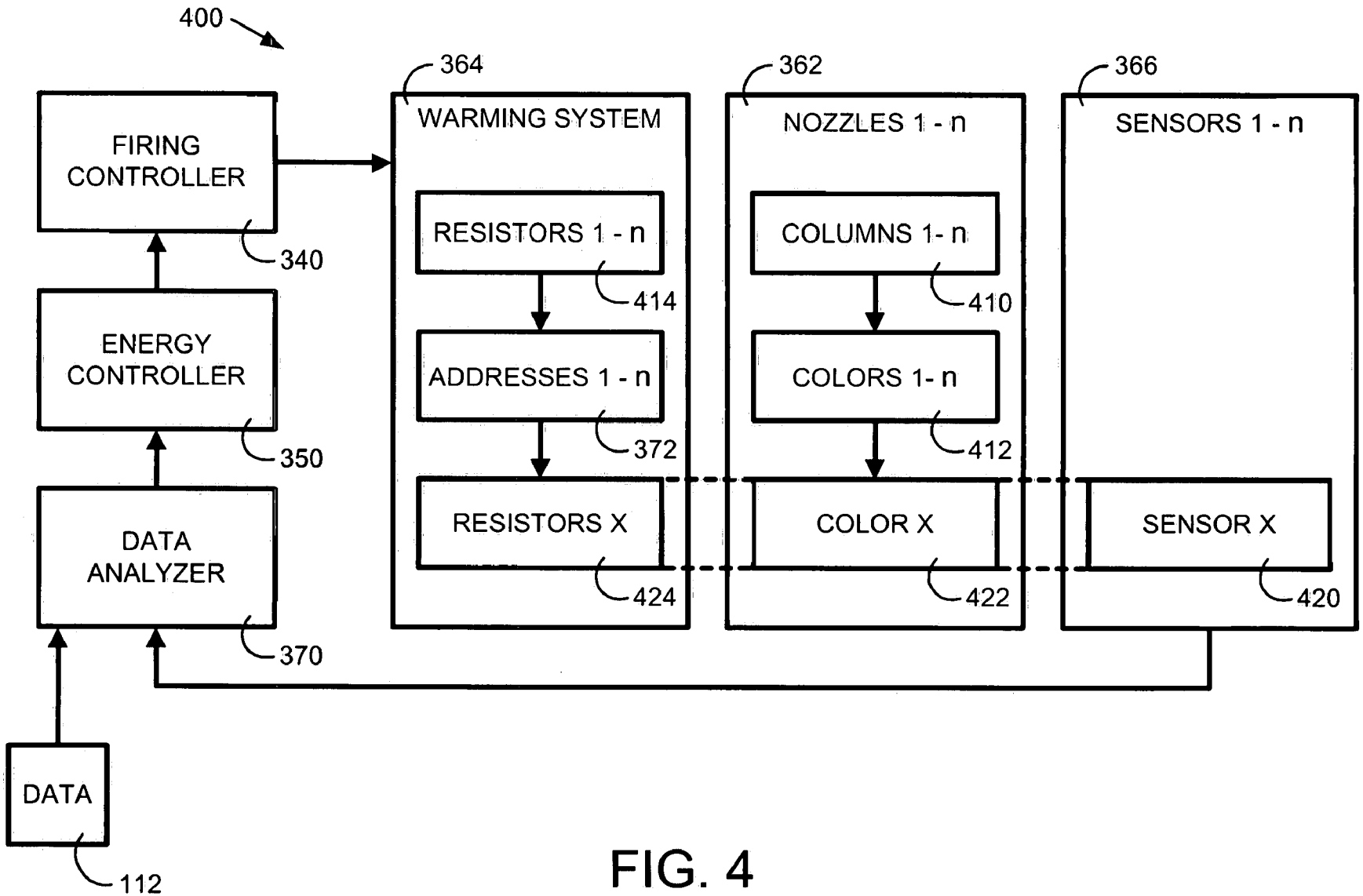
FIG. 4 is a flow diagram of one embodiment of a nozzle member portion of the printing environment of FIG. 3.

FIG. 4 shows a detailed block diagram 400 of one embodiment of portions of the system of FIG. 3, including the nozzles 362 of nozzle member 360. Referring to FIG. 3 along with FIG. 4, in general the nozzles 362 may be organized into columns 410 by colors 412; however other arrangements of nozzles may be used such as circular or oval patterns, zigzag patterns, etc., and the use of columns 410 is by way of example only for the purposes of discussion. The nozzles for a particular color selected from a range of available colors 412 may be arranged in close proximity; although other arrangements may be more suitable in other implementations.

The trickle warming system 126 (FIG. 1) includes a series of pre-warming resistors, here illustrated as being firing resistors 414, which are associated with ink ejecting nozzles 362 (FIG. 3). An integrated circuit chip, which may be in the data analyzer 370, may provide the resistors 414 with operational electrical signals, such as firing signals for ejecting ink droplets, pre-warming pulses having energy values lower than those of the firing signals to pre-warm the ink prior to beginning a swath. Pre-warming the ink to an optimal temperature produces droplets which are placed more accurately on the print media and therefore improve the quality of the printed output on media 120.

In one embodiment, the ideal temperature for ejecting a droplet varies with the color of the ink being ejected from a multi-color printhead. For example, one four-color printhead design ejects cyan, magenta, yellow and black colored inks. In this embodiment, the ideal ejection temperature for black ink is 40° C. (Celsius) and 45° C. for colored ink. Below these temperatures, the ink drop weight is lower than that required for an ideal ink droplet. If the temperature rises over 50° C., the risk of nozzle choking through bubble formation becomes a real possibility, which in an extreme case may cause the heating element to overheat, for instance, in the illustrated embodiment to a potentially damaging temperature of 500° C. in three microseconds. Thus, a temperature monitoring control system including sensors 336 (FIG. 3) may be exercised to keep temperatures within working limits.

To achieve this printhead temperature control, in one embodiment of the present invention, the controller 310 includes the temperature feedback system 376 which is configured to monitor and control the baseline operating temperature of the printhead 124. The temperature feedback system 376 may receive a temperature indication from a particular sensor (X) 420, which monitors the temperature of a specific section of the printhead substrate, for instance a section or region where nozzles are located ejecting a specific color (X) 422. If the temperature is below the threshold baseline pre-warm temperature, the temperature feedback system 376 may activate a heater element array comprising resistors (X) 424 located in the printhead nozzle sector monitored by sensor 420 for nozzles needing pre-warming. In FIG. 4, the variable "X" used with resistors 424, color 422 and sensor 420 indicates that these are all mutually associated items, with resistors X 424 being used to pre-warm the ink of color X 422 ejected by one or more nozzles 1-n 362, with the temperature in the region of these associated nozzles being monitored by sensor X 420. As mentioned above, in some implementations, rather than dedicating a temperature sensor to each firing resistor, a single sensor X 420 may be used to monitor the temperature associated with several nozzles physically located near one another in a sector of the printhead. If the temperature is above a maximum value, the temperature feedback system 376 may deactivate the heating elements during pre-warming or deactivate the firing resistors during printing to allow the printhead to cool to a temperature within acceptable limits.

Using this dynamic printhead temperature monitoring and control system 376 allows for other energy conservation schemes. For example, during printing of a swath, if the temperature of the firing resistors remains above the target pre-warming temperature the trickle warming system 126 may be turned off, further conserving energy. As another example, for a swath beginning in green and ending in cyan, while only the resistors associated with the cyan and yellow nozzles are preheated, at the beginning of the cyan only printing, pre-warming power for the yellow nozzles may be deactivated, in a mid-swath correction based on the mid-swath selection criteria 228 listed in Table 1 above.

As another example, for multi-colored printheads carrying both full and reduced dye loads of a given color or colors, typically cyan and magenta, some print jobs may default based on the type of media used. For instance, plain paper print jobs do not use the reduced dye loads to avoid saturating the paper, so upon detecting plain paper, the reduced dye load arrays for cyan and magenta are not pre-warmed. As a further example, transparencies typically do not receive the reduced dye loads to avoid bleeding of one color into another, so again upon detecting a transparency, the reduced dye load arrays for cyan and magenta are not pre-warmed. Thus this approach comprises the media based selection criteria 228 listed in Table 1 above, where which nozzles are pre-warmed and which are not may be selected prior to printing an entire page, instead of on a swath-by-swath basis. For example, using the media based selection criteria 228, only full dye loads of ink are pre-heated for transparencies and plain paper, but not reduced dye loads, while all dye loads are pre-warmed for photographic and premium papers.

The print quality based selection criteria 228 of Table 1 for pre-warming nozzles is another example of a cost saving technique for pre-warming only a portion or portions of the printhead. As mentioned above, examples of typical print quality selections are "best," "normal" and "draft," which may be selected through the printer driver or often using an input keypad located on the exterior of the printing mechanism. While the "best" print mode typically uses all of the nozzles, the "normal" mode may exclude reduced dye base colors, and the "draft" mode may use only one column of a pair for a given color. The print quality based selection criteria 228 is another example of a pre-warming decision which may be made on an entire page (or print job) basis, rather than on a swath-by-swath basis, similar to the media based selection criteria 228 discussed above.

Use of the color based selection criteria 228 of Table 1 produces significant power savings, particularly when printing black text from a six color printhead, such as one caring full dye loads of black, cyan, yellow and magenta inks, along with reduced dye loads of cyan and magenta inks. Using earlier methods of pre-warming, all of the nozzles consumed 30 watts of power, as compared to pre-warming the black ink only, which consumes only 18 watts of power, which is a 40% power savings, a result particularly important to consumers printing mostly with black, such as for text. Moreover, the reduced average power needed for the printhead allows optimization of the power supply, reducing raw material costs needed to build the printer, resulting in a more economical product for consumers.

V. Conclusion

Thus, a system for pre-warming only a portion(s) of an inkjet printhead prior to printing a swath has been presented with respect to several illustrated embodiments. One embodiment uses a color based selection criteria, where only the colors of ink in the upcoming swath are pre-warmed. Another embodiment uses a media based selection criteria, with the type of media determines which dye loads of colors are pre-warmed. Another embodiment uses a print quality based selection criteria, where the print quality (e.g., best, normal or draft) is used to determine which dye loads of colors or nozzle columns are pre-warmed. Another embodiment uses a mid-swath based selection criteria, were nozzles which are used initially during a print swath and later no longer needed, have pre-warming ceased at the point where they are no longer required. The term "mid-swath" may be a slight misnomer, but to clarify, this turn off point need not be at the middle of the swath, but somewhere between the beginning and end of the swath sometime after the nozzles are no longer required. Another embodiment uses a beginning of printing based selection criteria, where the pre-warming is stopped after printing has begun. Another embodiment uses a temperature based selection criteria, where pre-warming is stopped during a print swath when nozzle firing is capable of maintaining portions of the printhead at the desired pre-warming temperature. This temperature based selection criteria system facilitates independent temperature control of portions of the printhead during a print swath.

In conclusion, with the system and method of the present invention, an efficient and proactive printhead 124 is established through the temperature sensor feedback and control system 366, 376 and pre-warming system 364. This system maintains the relevant sections of the printhead at an optimum temperature before the heating energy is transferred to the firing resistors for producing droplets from multi-color inkjet printheads. A net effect of this system is that high quality ink droplets are produced at a reduced energy cost, as well as providing a more economical inkjet printing mechanism by optimizing power source design.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

The invention claimed is:

1. A printing system, comprising:

a printhead having plural portions each having an ink-ejecting nozzle located therein;

plural temperature sensors each associated with one of said plural portions to monitor the temperature thereof;

plural heating elements, each associated with one of said plural portions to apply heat thereto in response to a pre-warming signal; and a controller configured to generate separate pre-warming signals for each of the plural heating elements in response to the plural temperature sensors to elevate the temperature of at least one of said plural portions to a pre-warming temperature, wherein:

the controller is configured to analyze which plural portions are required to eject ink during print swath;

the controller is configured to continue to generate pre-warming signals for the required plural portions after printing of said print swath has begun; and while printing said print swath, after ink ejection from one of said plural portions is no longer required to complete said print swath, the controller is configured to cease to generate a pre-warming signal therefor.

2. A method of pre-warming a multi-color inkjet printhead comprising:

providing plural ink-dispensing portions in the printhead, each of the plural portions comprising a predetermined plurality of ink ejection elements all configured to eject a particular color ink having a particular dye-load;

analyzing an upcoming print swath;

determining from said analyzing which of said plural portions are a dispensing portion required to dispense ink, and which of said plural portions are a non-dispensing portion not required to dispense ink during printing of said upcoming print swath;

generating a pre-warming signal for said dispensing portion;

pre-warming said dispensing portion in response to the pre-warming signal; and omitting generation of a pre-warming signal for said non-dispensing portion to produce no pre-warming thereof, wherein the pre-warming signal to the dispensing portion is generated in accordance with a predefined selection criteria that specifies an event after which the pre-warming signal ceases.

3. The method of claim 2, further comprising:

monitoring the temperature of at least some of said plural portions; and wherein said generating of said pre-warming signal and said omitting generation of a pre-warming signal are conducted in response to said monitoring.

4. The method of claim 2, further comprising:

beginning printing of a print swath; and ceasing generation of the pre-warming signal upon said beginning.

5. The method of claim 2, wherein the pre-warming signal is generated before beginning printing of the print swath.

6. A method of pre-warming a multi-color inkjet printhead having plural portions dispensing ink, comprising:

analyzing an upcoming print swath;

determining from said analyzing which of said plural portions are a dispensing portion required to dispense ink and which of said plural portions are a non-dispensing portion not required to dispense ink during printing of said upcoming print swath;

generating a pre-warming signal for said dispensing portion;

pre-warming said dispensing portion in response to the pre-warming signal omitting generation of a pre-warming signal for said non-dispensing portion to produce no pre-warming thereof;

printing a print swath from a beginning point to an ending point;

continuing generation of the pre-warming signal after printing from the beginning point;

monitoring printing temperature of each of said plural portions during said printing; and ceasing to generate the pre-warming signal when the printing temperature exceeds a threshold temperature before printing to the ending point.

7. A method of pre-warming a multi-color inkjet printhead having plural portions dispensing ink, including first and second portions, comprising:

generating a pre-warming signal for said first portion;

pre-warming said first portion in response to the pre-warming signal;

omitting generation of a pre-warming signal for said second portion to produce no pre-warming thereof, analyzing an upcoming print swath;

determining from said analyzing which of said plural portions are transitional portions required to dispense ink over an initial segment of said upcoming print swath, and not required to dispense ink over a final segment of said upcoming print swath; and from said determining, continuing generation of the pre-warming signal for said transitional portions during printing of the initial segment and ceasing generation of the pre-warming signal during printing of the final segment.

8. A printing system, comprising:

means for ejecting ink from plural portions of an inkjet printhead;

means for heating each of said plural portions in response to a pro-warming signal;

means for generating the pre-warming signal for one of said plural portions;

means for omitting generation of the pre-warming signal for another of said plural portions;

means for determining when said one of said plural portions is required to print during an initial segment of a print swath and is not required to print during a final segment of the print swath; and means for ceasing generation of the pre-warming signal during printing of the print swath after printing said initial segment.

9. A printing system, comprising:

an inkjet printhead having plural portions each having an ink-ejecting nozzle;

plural heater elements each associated with one of said plural portions to pre-warm ink dispensed by the nozzle of said associated portion in response to a pre-warming signal; and a controller configured to analyze an upcoming print swath to determine which of said plural portions are required to eject ink in order to print the swath in accordance with a predefined selection criteria different from the upcoming print swath, and supply the pre-warming signal to one or more heater elements of only the portions required to eject ink to print the swath in accordance with the predefined selection criteria wherein particular ones of the plural portions are configured to eject a particular color ink, and wherein the selection criteria specifies a subset of the particular plural portions to be used to print the swath.

10. A printing system, comprising:

an inkjet printhead having plural portions each having an ink-ejecting nozzle;

plural heater elements each associated with one of said plural portions to pre-warm ink dispensed by the nozzle of said associated portion in response to a pre-warming signal; and a controller configured to analyze an upcoming print swath to determine which of said plural portions are required to eject ink in order to print the swath in accordance with a predefined selection criteria, and supply the pre-warming signal to one or more heater elements of only the portions required to eject ink to print the swath in accordance with the predefined selection criteria, wherein the selection criteria specifies an event after which the controller stops supplying the pre-warming signal to the heater elements of the portions required to eject the ink to print the swath during the printing of the swath.

11. A method of pre-warming a multi-color inkjet printhead having plural portions dispensing ink, comprising:

analyzing an upcoming print swath;

determining from said analyzing which of said plural portions are a dispensing portion required to dispense ink, and which of said plural portions are a non-dispensing portion not required to dispense ink during printing of said upcoming print swath;

generating a pre-warming signal for said dispensing portion;

pre-warming said dispensing portion in response to the pre-warming signal;

omitting generation of a pre-warming signal for said non-dispensing portion to produce no pre-warming thereof;

beginning printing of a print swath having a plurality of segments; and ceasing generation of the pre-warming signal for a particular dispensing portion during printing of a final segment of the print swath.

12. A method of pre-warming a multi-color inkjet printhead having plural portions dispensing ink, comprising:

analyzing an upcoming print swath;

determining from said analyzing which of said plural portions are a dispensing portion required to dispense ink, and which of said plural portions are a non-dispensing portion not required to dispense ink during printing of said upcoming print swath;

generating a pre-warming signal for said dispensing portion;

pre-warming said dispensing portion in response to the pre-warming signal;

omitting generation of a pre-warming signal for said non-dispensing portion to produce no pre-warming thereof:

beginning printing of a print swath; and ceasing generation of the pre-warming signal for a particular dispensing portion during printing of the print swat after ink dispensing from the particular dispensing portion is concluded for the print swath.

* * * * *

UNITED STATES PATENT AND TRADEMARK OFFICE

CERTIFICATE OF CORRECTION

PATENT NO. : 7,341,324 B2
APPLICATION NO. : 10/691311
DATED : March 11, 2008
INVENTOR(S) : Ronald A. Juve et al.

It is certified that error appears in the above-identified patent and that said Letters Patent is hereby corrected as shown below:

In column 10, line 41, in Claim 6, after “ink” insert -- , --.

In column 10, line 47, in Claim 6, after “signal” insert -- ; --.

In column 10, line 67, in Claim 7, after “thereof” delete “,” and insert -- ; --, therefor.

In column 11, line 16, in Claim 8, delete “pro-warming” and insert -- pre-warming --, therefor.

In column 12, line 48, in Claim 12, after “thereof” delete “:” and insert -- ; --, therefor.

In column 12, line 52, in Claim 12, delete “swat” and insert -- swath --, therefor.

Signed and Sealed this

Nineteenth Day of August, 2008

JON W. DUDAS
*Director of the United States Patent and Trademark Office*